US009534829B2

(12) United States Patent
Held

(10) Patent No.: US 9,534,829 B2
(45) Date of Patent: Jan. 3, 2017

(54) REFRIGERATION APPLIANCE

(71) Applicant: Miele & Cie. KG, Guetersloh (DE)

(72) Inventor: Benjamin Held, Bad Oeynhausen (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/719,337

(22) Filed: May 22, 2015

(65) Prior Publication Data

US 2015/0338156 A1 Nov. 26, 2015

(30) Foreign Application Priority Data

May 26, 2014 (DE) ..... 10 2014 107 367

(51) Int. Cl.

| | |
|---|---|
| ***F25D 23/00*** | (2006.01) |
| ***F25D 23/02*** | (2006.01) |
| ***F25D 29/00*** | (2006.01) |
| ***E05D 7/00*** | (2006.01) |
| *E05F 15/619* | (2015.01) |

(52) U.S. Cl.

CPC ..... *F25D 23/028* (2013.01); *E05D 7/00* (2013.01); *F25D 29/005* (2013.01); *E05F 15/619* (2015.01); *E05Y 2201/426* (2013.01); *E05Y 2600/41* (2013.01); *E05Y 2800/23* (2013.01); *E05Y 2900/31* (2013.01); *F25D 2700/02* (2013.01)

(58) Field of Classification Search

CPC ..... F25D 23/02; F25D 23/028; F25D 23/062; F25D 23/065; F25D 29/005; E05D 7/00; E05F 15/70; E05F 15/121; E05F 15/619

USPC ... 312/405, 405.1, 319.2, 319.5, 319.7, 326, 312/329; 49/276; 292/DIG. 72

See application file for complete search history.

(56) References Cited

U.S. PATENT DOCUMENTS

| | | | | |
|---|---|---|---|---|
| 5,023,413 | A * | 6/1991 | Staples | H01H 13/063 200/295 |
| 6,338,536 | B1 * | 1/2002 | Ueno | E05B 17/0033 312/405 |
| 8,234,818 | B2 * | 8/2012 | Hecht | E05F 15/70 49/31 |
| 2005/0045457 | A1 * | 3/2005 | Park | F25D 29/005 200/61.7 |
| 2009/0031634 | A1 * | 2/2009 | Glanz | E05D 5/12 49/324 |

(Continued)

FOREIGN PATENT DOCUMENTS

| | | | |
|---|---|---|---|
| DE | 202005011427 | U1 | 11/2006 |
| DE | 102006061083 | A1 | 6/2008 |

(Continued)

OTHER PUBLICATIONS

U.S. Appl. No. 14/719,343, filed May 22, 2015.

*Primary Examiner* — James O Hansen

(74) *Attorney, Agent, or Firm* — Leydig, Voit & Mayer, Ltd.

(57) ABSTRACT

A refrigeration appliance includes a body; a door hinged to the body and closing an interior of the refrigeration appliance; a seal disposed between the door and the body; and a control unit for actuating an opening mechanism acting on the door whose control signal, which triggers the opening of the door, is configured to be generated by at least one sensor which cooperates with a plunger and operates based on a piezoelectric effect, wherein the refrigeration appliance has a sensor unit in which the plunger is axially movably supported and indirectly coupled to the sensor by a biased spring element.

12 Claims, 5 Drawing Sheets

(56) References Cited

U.S. PATENT DOCUMENTS

| | | | | |
|---|---|---|---|---|
| 2010/0018240 | A1 | 1/2010 | Hecht et al. | |
| 2010/0307189 | A1 | 12/2010 | Keller et al. | |
| 2011/0083461 | A1* | 4/2011 | Kim | E05F 15/619 62/264 |

FOREIGN PATENT DOCUMENTS

| | | | | |
|---|---|---|---|---|
| EP | 2710923 | A1 | 3/2014 | |
| JP | 2003-185333 | * | 7/2003 | F25D 23/02 |
| KR | 2009-0128907 | * | 12/2009 | |
| WO | WO 2006017863 | A1 | 2/2006 | |

* cited by examiner

REFRIGERATION APPLIANCE

CROSS-REFERENCE TO PRIOR APPLICATION

Priority is claimed to German Patent Application No. DE 10 2014 107 367.3, filed on May 26, 2014, the entire disclosure of which is hereby incorporated by reference herein.

FIELD

The present invention relates to a refrigeration appliance.

BACKGROUND

Refrigeration devices, such as, for example, refrigerators, freezers or wine storage cabinets, tend to become increasingly large to provide larger storage capacity. Regardless of their use, such refrigeration appliances have a body having an interior for receiving the objects or products to be cooled, and a door attached to the body. Refrigeration appliances always have an elastically deformable seal disposed between the body and the door to prevent warm air from entering the interior, and to prevent the cold present therein from escaping to the outside when the refrigeration appliance is closed. Consequently, the seal is of particular importance because it is also decisive for the power consumption of the refrigeration appliance. Due to the temperature difference between the environment and the interior of the refrigeration appliance, the warm air that has entered the interior of the refrigeration appliance after opening the door is cooled once the door is closed, causing a decrease in the volume of the air, as a result of which a vacuum develops in the interior of the refrigeration appliance and presses the door against the body with a force increased by the ambient air pressure. As a result of this naturally increased door-closing force, the door may be impossible to open or may be openable only with substantial force, especially with increasing size of the refrigeration appliances.

In order to reduce this force, German Utility Model DE 20 2000 011 427 U1 describes a refrigeration appliance having a body and a door closing the same, where an opening mechanism referred to as "drive means" acts on the door and is actuatable by a trigger sensor. According to the disclosure of this document, the trigger sensor may operate based on different principles, of which mechanical, acoustic or optical operating principles are mentioned by way of example. This document also mentions a force sensor which senses an actuation force acting on the door. Thus, the opening mechanism can be activated, for example, by slightly pushing against the door or slightly pulling on the door handle. The opening mechanism used here is an electric motor having bevel gearing.

Further, DE 20 2005 011 427 U1 also presents an opening mechanism which is composed of a driving gear wheel and a toothed rack and intended solely to assist the opening movement.

In German Patent Application DE 10 2006 061 083 A1, a sensor is described which is preferably disposed in the interior of the refrigeration appliance and, in accordance with the disclosure of this document, may take the form of both a tension sensor and a pressure sensor. This sensor, too, serves to sense movement of the door through pressure measurement, the signal being usable for activating an opening mechanism via a control circuit.

The approaches known heretofore have been found to have the disadvantage that the individual components have to be mounted at specific positions of the refrigeration appliance, which overall makes them complex to install. Some designs provide that the sensor is installed in the door, as a result of which electrical lines need to be run from the body into the door, which entails additional complexity. In sum, until now, there are no designs of opening mechanisms in refrigeration appliances that would be easy to install and, in addition, also satisfy aesthetic considerations.

SUMMARY

A refrigeration appliance comprising: a body; a door hinged to the body and closing an interior of the refrigeration appliance; a seal disposed between the door and the body; and a control unit for actuating an opening mechanism acting on the door whose control signal, which triggers the opening of the door, is configured to be generated by at least one sensor which cooperates with a plunger and operates based on a piezoelectric effect, wherein the refrigeration appliance has a sensor unit in which the plunger is axially movably supported and indirectly coupled to the sensor by a biased spring element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
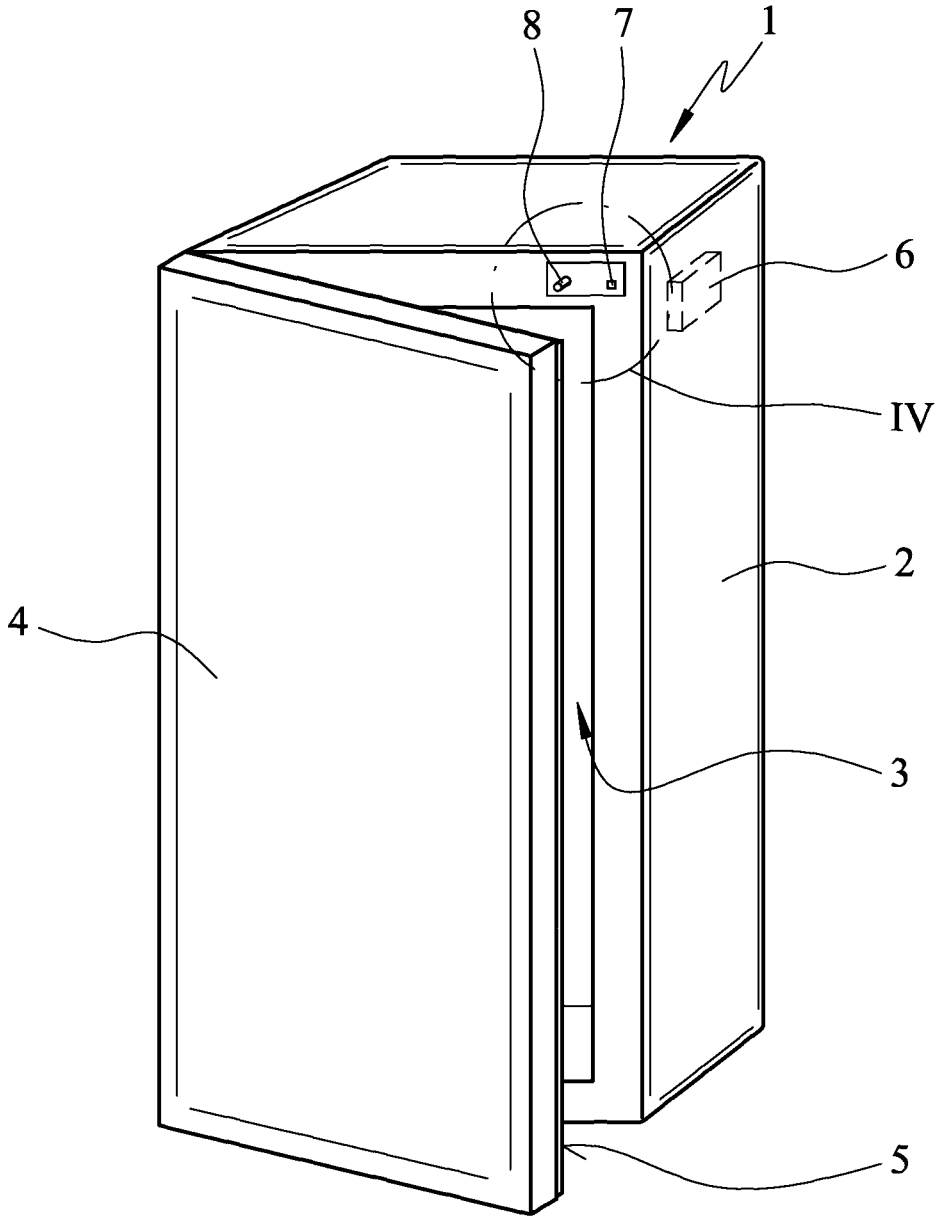
FIG. 1 is a perspective view of a refrigeration appliance according to the present invention.

A refrigeration appliance of the type concerned here includes a body, a door hinged to the body and closing an interior of the refrigeration appliance, a seal disposed between the door and the body, as well as a control unit for actuating an opening mechanism acting on the door, whose control signal, which triggers the opening of the door, is generatable by at least one sensor which cooperates with a plunger and operates based on the piezoelectric effect. The improvement of such a refrigeration appliance consists in that the refrigeration appliance has a sensor unit in which the plunger is axially movably supported and indirectly coupled to the sensor by a biased spring element.

In addition to the possibility of combining the entire mechanical and sensor system into one sensor unit and thereby achieving a very compact design, another advantage achievable by the present invention is that it allows the length of the travel of the plunger to be increased by the interposed spring element, as a result of which the accuracy of the signal transmission is increased. Here, the plunger no longer acts directly on the sensor, but indirectly via the spring element, whose design and, in particular, length are variable. Furthermore, the bias of the spring element ensures permanent contact of the plunger against the sensor, thereby making it possible to avoid misinterpretations or erroneous measurement values. In addition, the approach according to the present invention provides a simple, optimized way of compensating for tolerances.

A further, very important advantage of the present invention is that the sensor is one which operates based on the piezoelectric effect. This means that the sensor used may be a piezoelectric sensor, a piezoresistive sensor, or a magnetoelastic sensor. In connection with such sensors, it should be noted in particular that they allow for virtually no working travel, which means that the plunger used must be accurately aligned with the sensor or in direct contact therewith to ensure most accurate measurement results. In the case of the piezoelectric sensors preferably used here, a pressure force applied to the sensor generates an electrical voltage which may be further processed as a signal.

In contrast, in piezoresistive sensors, the electrical resistance is used as a signal. Such a sensor is a pressure sensor, in which a diaphragm is flexed in response to a mechanical pressure difference between one side and the opposite side, as a result of which the electrical resistance changes. Magnetoelastic sensors, in contrast, are based on the principle of electrical inductance, which changes under the action of a pressure force exerted on the sensor. In summary, it may be said that the proposed sensors, which operate based on the piezoelectric effect, make it possible to use a wide range of different sensors, which allows the acquisition of measurement values for actuating the opening mechanism to be implemented in a manner which is highly flexible and adapted to the specific characteristics of a refrigeration appliance.

Moreover, an "opening mechanism" as understood in the context of the present invention may be one which merely assists the opening of the door, and one which is capable of entirely opening the door and/or closing it, as the case may be. It is possible to use, as the opening mechanism, known systems, such as, for example, units having an electric motor.

A first embodiment of the present invention provides for the sensor unit to be accommodated in a housing. Through this measure, all elements forming part of the sensor unit are combined in a common housing. Advantageously, this housing may be mounted at any location of the refrigeration appliance in the contact region of the door, which permits a high degree of freedom and variation in the structural design of a refrigeration appliance. Thus, it is no longer necessary to couple the sensor unit to a handle member of the refrigeration appliance. As already explained at the outset, the achievable length of travel of the plunger can be varied due to its indirect contact with the sensor via a spring element, which adds flexibility in terms of mounting location. Since the entire sensor unit is accommodated in a housing, the advantage is obtained that the individual elements of the sensor unit are also protected from damage. This makes the sensor unit much more rugged and less prone to failure than known designs.

Both sensors and opening mechanisms are often accommodated in the door of the refrigeration appliance. However, this has the distinct disadvantage that electrically conductive lines or cables need to be suitably run into the door hinged to the body of the refrigeration appliance. These lines or cables are mechanically stressed very heavily by the movements transmitted thereto during the opening and closing of the door, as a result of which electrical contacts may become loose or electrical lines may break. If such an event occurs, the refrigeration appliance must be laboriously repaired, which should be avoided for the sake of the user. For this reason, a refinement of the present invention provides for the sensor unit to be accommodated in the body of the refrigeration appliance. Such an approach has the advantage that the electrical lines to be installed are not subject to movements, which eliminates the risk of damage to the electrical lines or of electrical contacts becoming loose.

Moreover, through the use of the biased spring element cooperating with the plunger, it is advantageously achieved that the plunger is in permanent contact with a corresponding surface of the door when the door is closed. Thus, it can be ensured at all times that even the smallest movement of the door, whether in the pushing direction or the pulling direction, will be reliably transmitted to the sensor, as a result of which the opening of the door is accomplished in a very accurate manner. During calibration, the bias resulting from the spring element is defined as a "zero signal", so that a change in the movement of the spring element will immediately produce a measurement signal detectable by the sensor. This has the important advantage that the mounting location of the sensor unit in the body of the refrigeration appliance can be variably selected as long as touch contact is provided between the plunger and the closed door.

In order to achieve accurate contact between the spring element and the plunger, it is particularly preferred that the plunger be provided at its end received in the housing with a sleeve for receiving a portion of the spring element. Accordingly, the portion of the spring element facing the plunger is inserted into this sleeve and is both axially guided and laterally stabilized therein.

Similarly, in a refinement of this inventive idea, it is proposed that the spring element be inserted with its portion opposite the sleeve into a socket supported in the housing. In other words, the spring element has, at its opposite ends, two portions which are received in the sleeve and the socket, respectively, and are thereby axially guided and laterally stabilized. A clearance is provided between the sleeve and the socket in the axial direction of the spring element, in which clearance the spring element is not guided. The free space so created between the sleeve and the socket has various advantages. For example, the spring element could theoretically be provided with a curvature in this portion, if this should be required for structural reasons. Moreover, the aforementioned free space allows the clearance between the plunger and the sensor to be designed as needed, which in turn allows the entire sensor unit to be disposed at different mounting locations of the refrigeration appliance.

Since, in the inventive approach, the spring element is biased and used to bridge the gap between the plunger and the sensor, it is advantageous when the socket is provided on its outer circumferential surface with a contact surface for direct contact with the sensor. This contact surface can be freely configured and adapted to match the sensor, so that an optimal connection is provided between the contact surface and the sensor.

For this reason, in another embodiment, it is proposed that the contact surface of the socket contacting the sensor have a spheroid geometry, which is understood to be a spherical or approximately spherical geometry. The spheroid geometry of the contact surface is useful because the contact surface is always centered on the sensor, regardless of external conditions. In addition, the predominantly punctiform contact area with the sensor created as a result of the spheroid geometry decidedly improves the measurement accuracy, so that spurious signals and erroneous measurements can be ruled out. Since, in addition, only a very small sensor surface area is needed, the entire sensor unit can be reduced in size, which, overall, results in miniaturization.

In order to further improve the compact design of the entire sensor unit, one refinement of the present invention provides for the sensor to be disposed on a printed circuit board. In this case, the printed circuit board may also contain additional electronic components and even the control unit, for example, so that the sensor unit is altogether a complex object, yet requires little space.

In one variant of the present invention, the housing is provided with an electrical connector element for electrically connecting the sensor unit to the control unit and/or the opening mechanism. Such a design allows the sensor unit to be very easily assembled and fitted into the refrigeration appliance. Hardly any time is needed to establish the electrically conductive connections. The electrical connector element may be either a receptacle or a plug, which merely needs to be connected to the corresponding counterpart.

Moreover, according to another proposal of the present invention, the spring element is a helical compression spring. Such a component is commercially available, and thus provides a simple and therefore low-cost solution for the present application. Moreover, the specific spring characteristics of such compression springs are known and can be accurately determined for the intended application, which also allows for accurate prediction of expected measurement results.

In one variant of an embodiment of a sensor used, the sensor is a force sensor. Of course, a force sensor is also one which uses the piezoelectric effect.

It is standard to provide refrigeration appliances with pockets in the corner regions of the body, into which may be installed the joints that hold the door. Usually, such pockets are provided on both the left and right sides of a body. The reason for this is simply the ability to use a uniform body which may be equipped with doors that can be hinged; i.e., attached, on the left side or on the right side. The pockets on the respective strike side of the door, which are not needed, are mostly closed by covers, and thereby visually concealed. In accordance with a very advantageous proposal of the present invention, the pockets present in the body of the refrigeration appliance that are not needed for the door joints are used for accommodating the sensor unit together with the opening mechanism in a box and installing the same into these pockets. This first provides the important advantage that the box, as a very compact unit, contains both the opening mechanism and the sensor unit. In this connection, it is beneficial if the sensor unit is accommodated in a housing, which may be an integral part of the box. In other words, it is possible, on the one hand, to mount the housing of the sensor unit into the box. Alternatively, such a housing, into which the components of the sensor unit are integrated, may be provided directly in the box. Both approaches are possible and may be selected according to the particular conditions encountered. The flexibility of design results in particular from the fact that the box and/or the housing of the sensor unit may be made from plastic, so that the box and/or the housing may be formed of a small number of parts or as a one-piece component.

In order to be able to install the box in a pocket provided in the refrigeration appliance, various fastening options are possible. One very simple, yet effective way of mounting the box is to fix it in the pocket by clamping means. This may be accomplished using, for example, clamping lugs that engage suitable undercuts. These measures make it possible to significantly reduce the effort required for mounting the box, thereby reducing the overall manufacturing complexity of the refrigeration appliance.

The present invention will be described below in more detail with reference to the accompanying drawings. The exemplary embodiment shown is merely intended to illustrate the principle of the present invention, but should not be construed as limiting it to the variant shown.

Identical or similar components are denoted by the same reference numerals throughout. For the sake of illustrating the operation of the present invention, the figures are greatly simplified schematic views in which components not essential to the invention have been omitted. However, this does not mean that such components are not present in an approach in accordance with the present invention.

FIG. 1 shows a refrigeration appliance 1 in a perspective view. Refrigeration appliance 1 is essentially composed of a body 2 having an interior 3 formed therein for receiving the objects or products to be cooled. Body 2, and thus its interior 3, can be closed by a door 4 hinged to body 2. In the view of FIG. 1, door 4 is shown in an ajar position, so that peripheral seal 5 disposed on the interior side of door 4 facing body 2 can be seen. Seal 5 is made of an elastically deformable material and sealingly engages the corresponding surface of body 2 when door 4 is closed. As already explained at the outset, the sealing effect is increased by the vacuum developing in interior 3 of refrigeration appliance 1. As a result, door 4 is typically very difficult to open. For this reason, the refrigeration appliance 1 in FIG. 1 is provided in the upper right corner region with an opening mechanism 7, which can be actuated by a sensor 9 (not shown here) and a control unit 6 (only schematically indicated in FIG. 1) coupled to sensor 9. Sensor 9 forms part of a sensor unit 10 and is indirectly coupled to a plunger 8 protruding from the surface of body 2. As door 4 is closed, plunger 8 is pushed a certain distance into body 2 in the axial direction against the force of a spring element 12.

Figure 2:
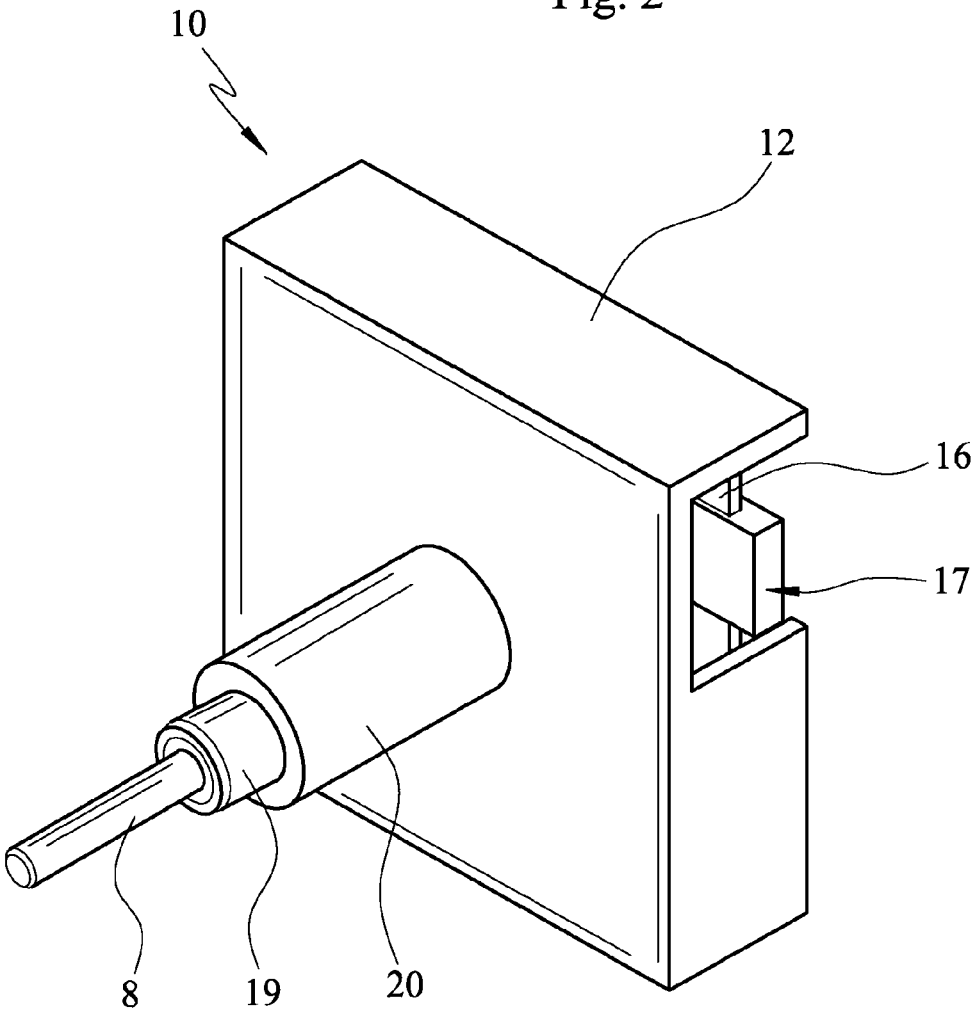
FIG. 2 is a three-dimensional view of a sensor unit.

FIG. 2 shows a three-dimensional view of a sensor unit 10. All of the individual components of sensor unit 10 are accommodated in a housing 12, so that sensor unit 10 can be mounted at different mounting locations of body 2 of refrigeration appliance 1 in such a way that it is protected from damage. At its front facing door 4, housing 12 is provided with a receiving portion 20 of circular-cylindrical shape, and whose intent will be discussed in greater detail below. Receiving portion 20 merges into an also circular-cylindrical sliding bearing portion 19 in the axial direction of plunger 8. Plunger 8 is axially movably supported in sliding bearing portion 19. By supporting plunger 8 within sliding bearing portion 19, it is also laterally guided, so that it can only move axially without interference effects. Furthermore, a connector element 17, which may be either a plug or a receptacle, is disposed at an outer side of housing 12, making it possible to easily establish an electrically conductive connection to associated components. In FIG. 2, connector element 17 is shown only in greatly simplified form. Furthermore, connector element 17 forms part of a printed circuit board 16, which also serves to receive additional electronic components.

Figure 3:
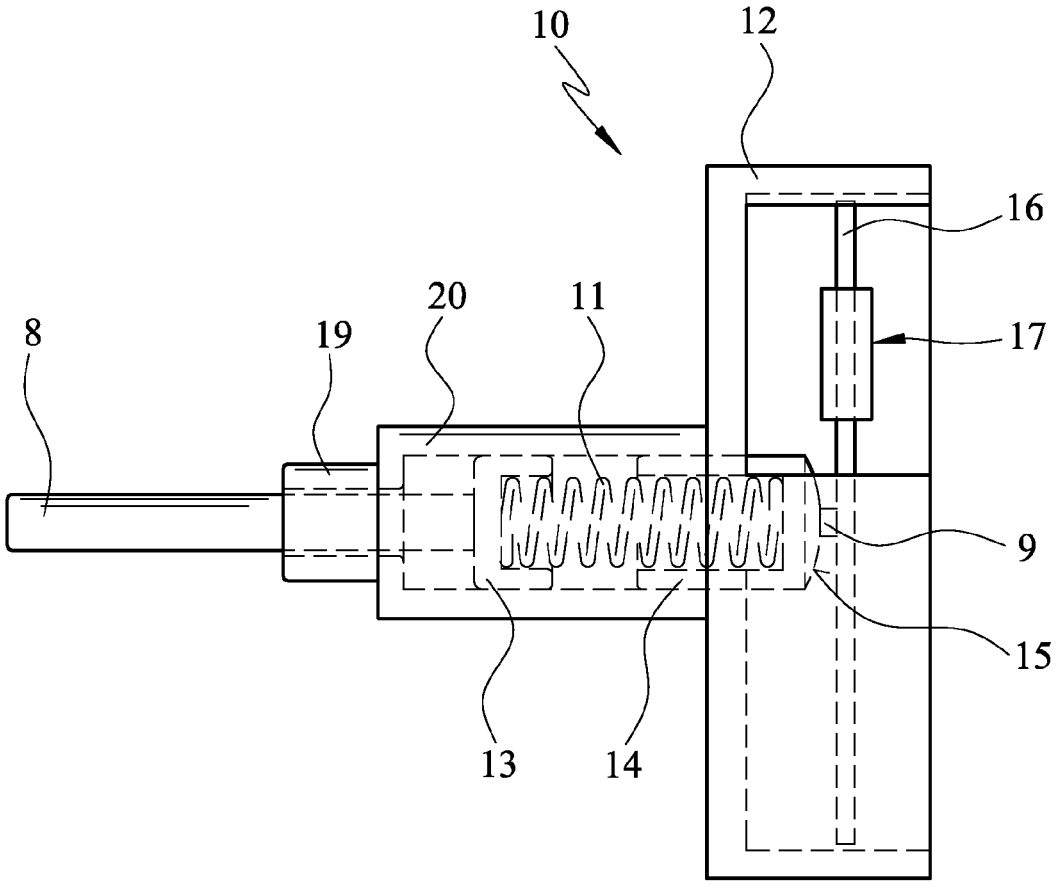
FIG. 3 is a partially cross-sectional view of the sensor unit of FIG. 2.

FIG. 3 shows a partial sectional view of sensor unit 10 of FIG. 2, illustrating the design of an exemplary sensor unit 10 according to the present invention. To begin with, printed circuit board 16 is mounted in housing 12. Printed circuit board 16 is provided at one side with connector element 17 and at approximately its center with sensor 9 which, in the present case, is a piezoelectric sensor, whose measurement signals are generated by application of a pressure force. The parameters so determined can be transmitted via connector element 17 to attached peripheral elements. At its front side facing door 4, housing 12 further has a sliding bearing portion 19 for slidingly supporting plunger 8, and a receiving portion 20 in which is located a spring element 11. A portion of spring element 11 is received and guided in a sleeve 13, which is an integral part of plunger 8. Moreover, the portion of spring element 11 opposite the sleeve 13 is inserted in a socket 14. A free space exists between sleeve 13 and socket 14 in the axial direction of plunger 8, in which free space spring element 11 is not guided. Spring element 11 makes it possible to increase the length of the reaction path between plunger 8 and sensor 9. Furthermore, socket 14 is provided on its outer circumferential surface with a contact surface 15 which, in the present case, has a spheroid geometry. As a result, a point contact is provided between sensor 9 and contact surface 15, which allows the measurement accuracy to be decidedly improved.

Figure 4:
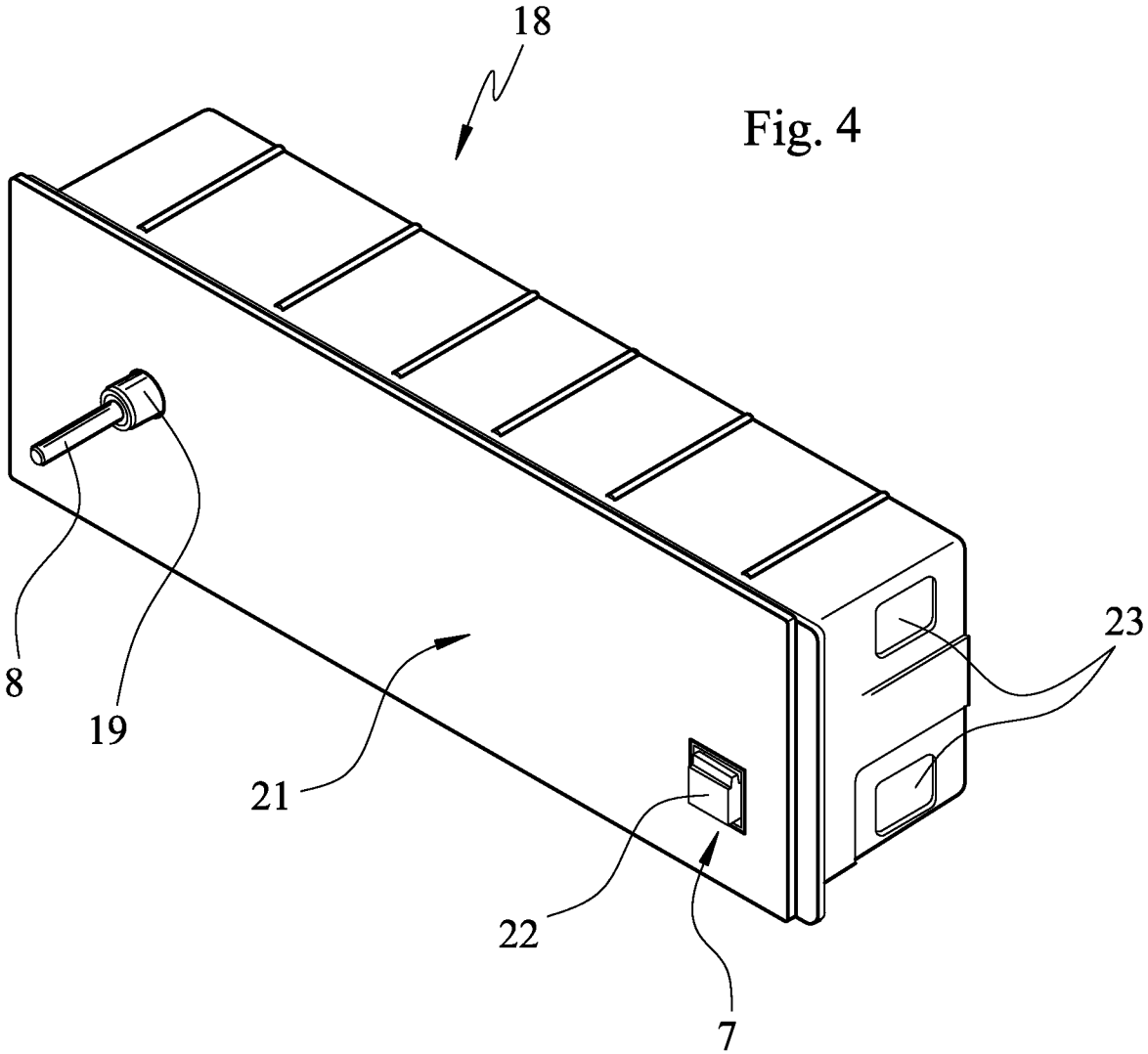
FIG. 4 is an enlarged view of detail IV of FIG. 1, showing a box with a sensor unit and an opening mechanism mounted therein.
Figure 5:
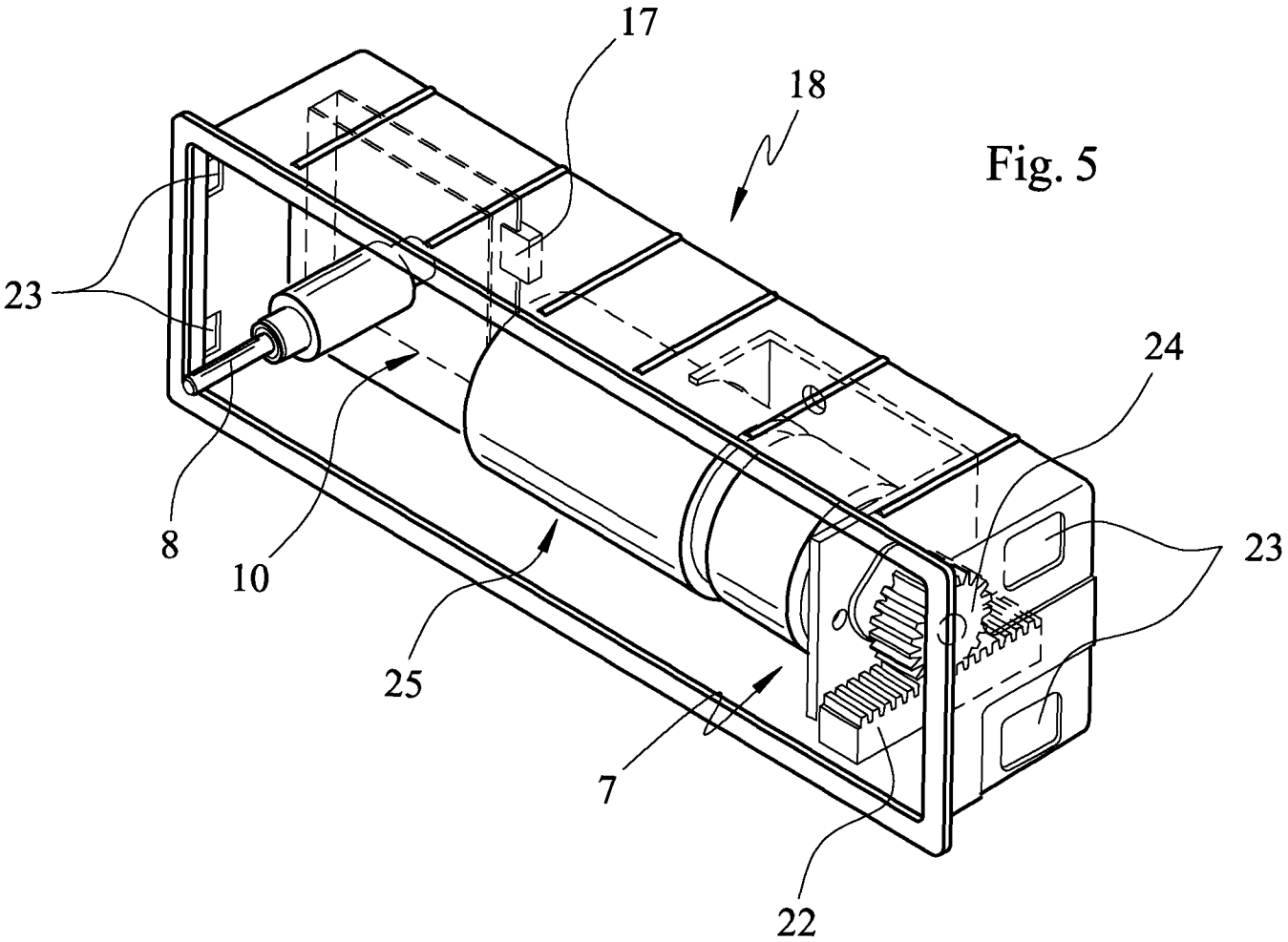
FIG. 5 is a view looking into the box of FIG. 4.

FIGS. 4 and 5 finally show another special feature of the present invention, which consists in that sensor unit 10 is mounted together with opening mechanism 7 in a box 18, which is shown as a unit in the three-dimensional view of FIG. 4, while FIG. 5 shows a view looking into the interior of box 18. Box 18 is closed by a cover 21, so that it is visually concealed after it is installed in a pocket of body 2 of refrigeration appliance 1. Usable for this purpose is a pocket which is usually used for installation of a joint for door 4, it being understood that the pocket accommodating box 18 is one which is located at the strike side of door 4 and not used for a joint. As can also be seen in FIG. 4, only a small portion of sliding bearing portion 19 as well as plunger 8 protrude from cover 21 in the left part of the figure. In the right part of FIG. 4, it can further be seen that an opening is provided here for opening mechanism 7. Discernible in this opening is the end portion of a toothed rack 22 forming part of opening mechanism 7. Furthermore, box 18 is provided at its sides with a plurality of clamping lugs 23 which cooperate with corresponding elements in the pocket of body 2 of refrigeration appliance 1, thus forming clamping means.

FIG. 5 provides a view into the interior of box 18. As can be seen, box 18 is provided at both end faces with a plurality of clamping lugs 23. Moreover, the entire sensor unit 10 accommodated in housing 12 is mounted in box 18. Furthermore, opening mechanism 7 is disposed immediately adjacent sensor unit 10. In the present case, opening mechanism 7 has an electric motor 25 and a gearing composed of a gear wheel 24 mounted on the shaft of electric motor 25 and engaged with toothed rack 22. A rotary movement of gear wheel 24 produced by electric motor 25 causes toothed rack 22 to reciprocate, as a result of which it may protrude from box 18, and thus from the surface of body 2 of the refrigeration appliance. As a result, toothed rack 22 exerts a force on closed door 4, which force is sufficient to assist the opening of the door and overcome the vacuum present in interior 3 of body 2. By mounting opening mechanism 7 and senor unit 10 into a common box 18, an overall very compact unit is provided which, in addition, can be installed in pockets of refrigeration appliance 1, which are present in body 2 of refrigeration appliance 1 anyway.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 refrigeration appliance
2 body
3 interior
4 door
5 seal
6 control unit
7 opening mechanism
8 plunger
9 sensor
10 sensor unit
11 spring element
12 housing
13 sleeve
14 socket
15 contact surface
16 printed circuit board
17 electrical connector
18 box
19 sliding bearing portion
20 receiving portion
21 cover
22 toothed rack
23 clamping lug
24 gear wheel
25 electric motor

What is claimed is:

1. A refrigeration appliance comprising:
a body;
a door hinged to the body and closing an interior of the refrigeration appliance;
a seal disposed between the door and the body;
an opening mechanism configured to act on the door;
a sensor unit accommodated in the body of the refrigeration appliance, the sensor unit comprising:
a plunger axially movably supported in the sensor unit;
a biased spring element; and
at least one sensor, accommodated in the body of the refrigeration appliance, which cooperates with the plunger and operates based on a piezoelectric effect, the plunger being indirectly coupled to the at least one sensor by the biased spring element, and a control unit for actuating the opening mechanism and whose control signal, which triggers the opening of the door, is configured to be generated by the at least one sensor, wherein an end of the plunger is received in a housing of the sensor unit and includes a sleeve configured to receive a portion of the spring element.

2. The refrigeration appliance of claim 1, wherein the sensor unit is accommodated as a unit in the housing.

3. The refrigeration appliance of claim 1, wherein the plunger is in permanent contact with a corresponding surface of the door when the door is closed.

4. The refrigeration appliance of claim 1, wherein a portion of the spring element opposite the sleeve is inserted into a socket supported in the housing.

5. The refrigeration appliance of claim 4, wherein an outer circumferential surface of the socket includes a contact surface configured to directly contact the sensor.

6. The refrigeration appliance of claim 5, wherein the contact surface of the socket that contacts the sensor has a spheroid geometry.

7. The refrigeration appliance of claim 1, wherein the sensor is disposed on a printed circuit board.

8. The refrigeration appliance of claim 1, wherein the housing of the sensor unit includes an electrical connector element configured to electrically connect the sensor unit to at least one of the control unit and the opening mechanism.

9. The refrigeration appliance of claim 1, wherein the spring element is a helical compression spring.

10. The refrigeration appliance of claim 1, wherein the sensor unit and the opening mechanism are disposed in a box.

11. The refrigeration appliance of claim 10, wherein the box is installed in a pocket in the body of the refrigeration appliance.

12. The refrigeration appliance of claim 11, wherein the box is fixed in the pocket by a clamping device.

* * * * *